US006666224B2

(12) United States Patent
Lee

(10) Patent No.: US 6,666,224 B2
(45) Date of Patent: Dec. 23, 2003

(54) BEACH UMBRELLA WITH LAMPS

(76) Inventor: Chorng-Cheng Lee, No. 272, Lane 365, Wu Feng South Road, Chia Yi (TW)

( * ) Notice: Subject to any disclaimer, the term of this patent is extended or adjusted under 35 U.S.C. 154(b) by 149 days.

(21) Appl. No.: 09/985,996

(22) Filed: Nov. 7, 2001

(65) Prior Publication Data

US 2003/0084931 A1 May 8, 2003

(51) Int. Cl.[7] ..... A45B 3/04
(52) U.S. Cl. ..... 135/910; 135/16; 362/102
(58) Field of Search ..... 135/16, 910; 362/102, 362/234, 249, 252

(56) References Cited

U.S. PATENT DOCUMENTS 5,758,948 A * 6/1998 Hale ..... 362/249
6,089,727 A * 7/2000 Wu ..... 135/910
6,302,560 B1 * 10/2001 Lai ..... 362/249
6,439,249 B1 * 8/2002 Pan et al. ..... 135/16
6,443,595 B1 * 9/2002 Tseng ..... 362/252
6,497,496 B2 * 12/2002 Wang ..... 362/249
2002/0124876 A1 * 9/2002 Chen ..... 135/16
2002/0145873 A1 * 10/2002 Rahman ..... 362/252
2002/0149934 A1 * 10/2002 Lin ..... 362/252
2003/0067765 A1 * 4/2003 Li ..... 362/102

FOREIGN PATENT DOCUMENTS

JP 2000354506 * 12/2000
JP 200117217 * 1/2001

* cited by examiner

*Primary Examiner*—Lanna Mai
*Assistant Examiner*—Hanh V. Tran
(74) *Attorney, Agent, or Firm*—Rosenberg, Klein & Lee

(57) ABSTRACT

A beach umbrella with lamps is provided with receiving trenches lengthwise on each of the ribs thereof, and the ribs each has several spaced through holes communicating with the trench. Several of the lamps are each connected to one of branches of a conductive wire. The wires are placed along the ribs, and the branches are each passed through one of the through holes with the wires and the lamps being arranged on two opposing sides of the ribs; when the trenches are formed on bottom of ribs, the lamps can be closely received in the trenches with most of the weight being supported by the wires held on the ribs, therefore the same can't possibly fall off even when the umbrella is being stretched or folded.

4 Claims, 9 Drawing Sheets

BEACH UMBRELLA WITH LAMPS

BACKGROUND OF THE INVENTION

The present invention relates to a beach umbrella with lamps, and more particularly, to one, of which the lamps take various forms and can be secured in proper position without possibility of moving or falling off or badly affecting the appearance of the umbrella.

Beach umbrellas are widely used not only on the beach to provide shade from the direct light of the sun but also on other outdoor recreational places, such as the areas for the spectators of a sport and outdoor coffee shops, such that people sitting under them can be protected from the sun and rain.

Beach umbrellas usually include a shank, several ribs radially spread out from the upper end of the shank, spreaders, which are pivoted to the middle portions of the ribs at the outer ends and pivoted to a slidable ring at the inner ends, and a canopy secured to the ribs.

Such beach umbrellas are not needed, and usually folded when there is no enough light or illumination lest the places under the canopy become too dark. However, it needs much additional labor to fold these umbrellas on an outdoor coffee shop where usually many such umbrellas are used. And, the dust on the canopies is likely to fall down to dirt the tables placed under the umbrellas when the umbrellas are folded. To avoid the above mentioned trouble, the umbrellas are not folded, but additional lamps are placed besides, or hung on, the umbrellas for the customers to see clearly with sufficient light; this approach also needs additional labor and therefore isn't ideal, and the lamps hung on the umbrellas would badly affect the look of the umbrella. In addition, because some beach umbrellas used on an outdoor coffee shop are fixed, and can't be moved away, the umbrellas would affect the look of the places for the worse when they are in the folded position.

To deal with the above problem, referring to FIGS. 9, 10 and 11, a beach umbrella with lamps is provided, which includes a shank 51, ribs and spreaders 52 radially spread out from the shank 51 and lamps 54. The ribs and spreaders 52 each has a receiving trench 53 on the lower side; the receiving trench 53 has a C-shaped section, i.e. the lower opening of the trench 53 is narrower than the other part of the trench 53. Several of the lamps 54 are connected to a wire 541 and received in one of the trenches 53 such that the same won't fall off the trenches 53 easily. And, because the lamps 54 are hidden in the trenches 53, the drawback of the lamps showing to badly affect the look of the umbrella is eliminated.

However, the umbrella is still found to have drawbacks as follows:

1. There is still a possibility that the lamps 54 fall out of the trenches 53, especially when the umbrella is being stretched on folded, because the lamps 54 are not firmly fixed to the ribs and spreaders 52.
2. The trenches 53 can only receive lamps of the same size, therefore lamps of different sizes can't be used on such umbrella, i.e. the use of the umbrella is very limited.

SUMMARY OF THE INVENTION

Therefore, it is a main object of the present invention to provide a beach umbrella with lamps, of which the lamps can be secured in position without possibility of falling off.

It is another object of the present invention to make the beach umbrella in such a manner that lamps of various shapes and sizes can be fitted thereto.

The beach umbrella of the present invention includes a shank, several ribs and spreaders, and lamps connected to branches of wires like the conventional one. The ribs each has a receiving trench lengthwise formed thereon, and several through holes communicating with the trench. The branches of the wires are each passed through a respective one of the through holes with the lamps and the wires being positioned on opposing sides of the ribs. When the receiving trenches are formed on the bottoms of the ribs, the lamps can be further hidden in the trenches. When the receiving trenches are formed on the upper sides of the ribs, the wires are hidden along the trenches with the lamps be positioned below the ribs.

BRIEF DESCRIPTION OF THE DRAWINGS

This invention will be better understood by referring to the accompanying drawings, wherein.

DETAILED DESCRIPTION OF THE PREFERRED EMBODIMENTS

Figure 1:
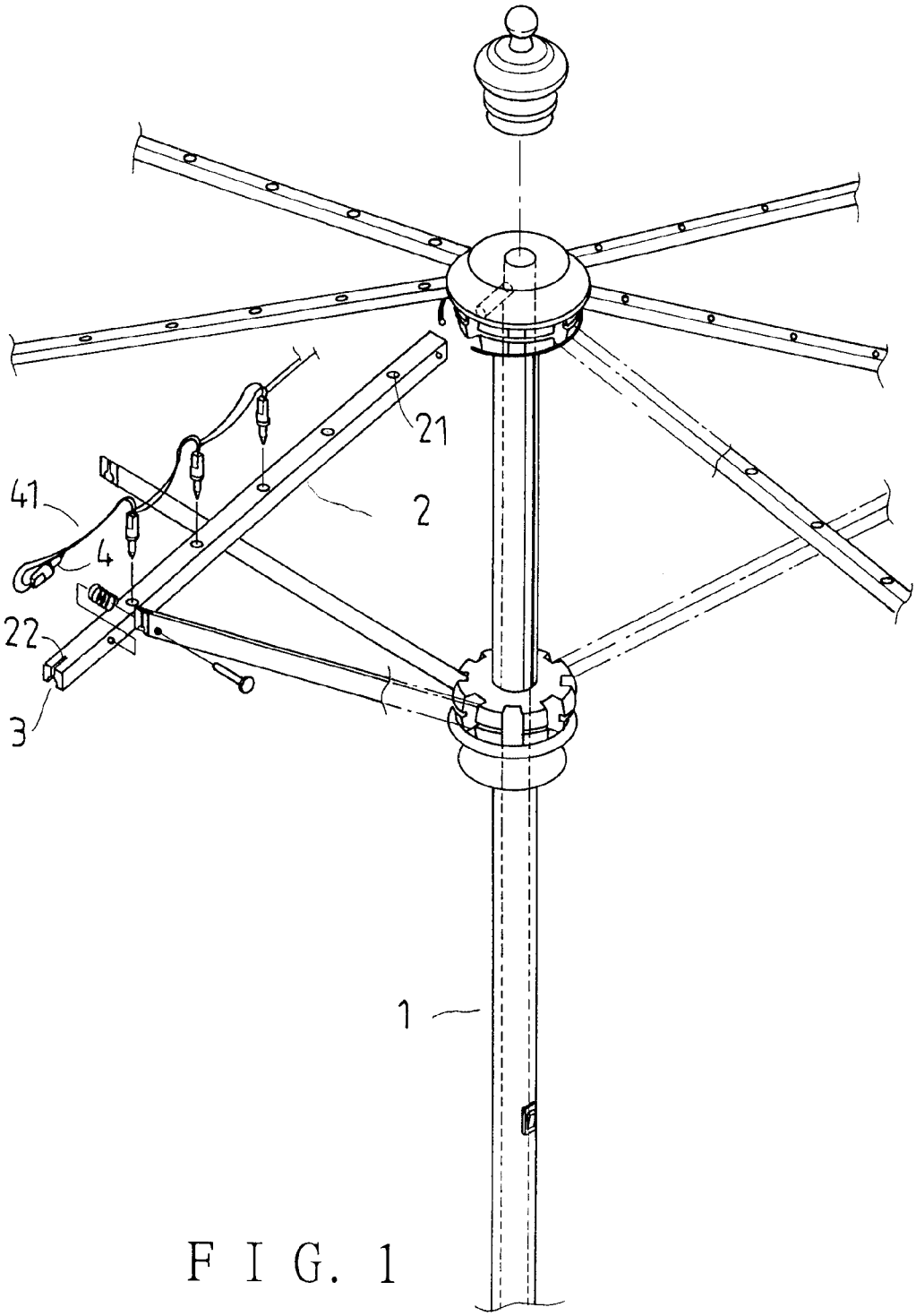
FIG. 1 is an exploded perspective view of the beach umbrella with lamps of the present invention.
Figure 2:
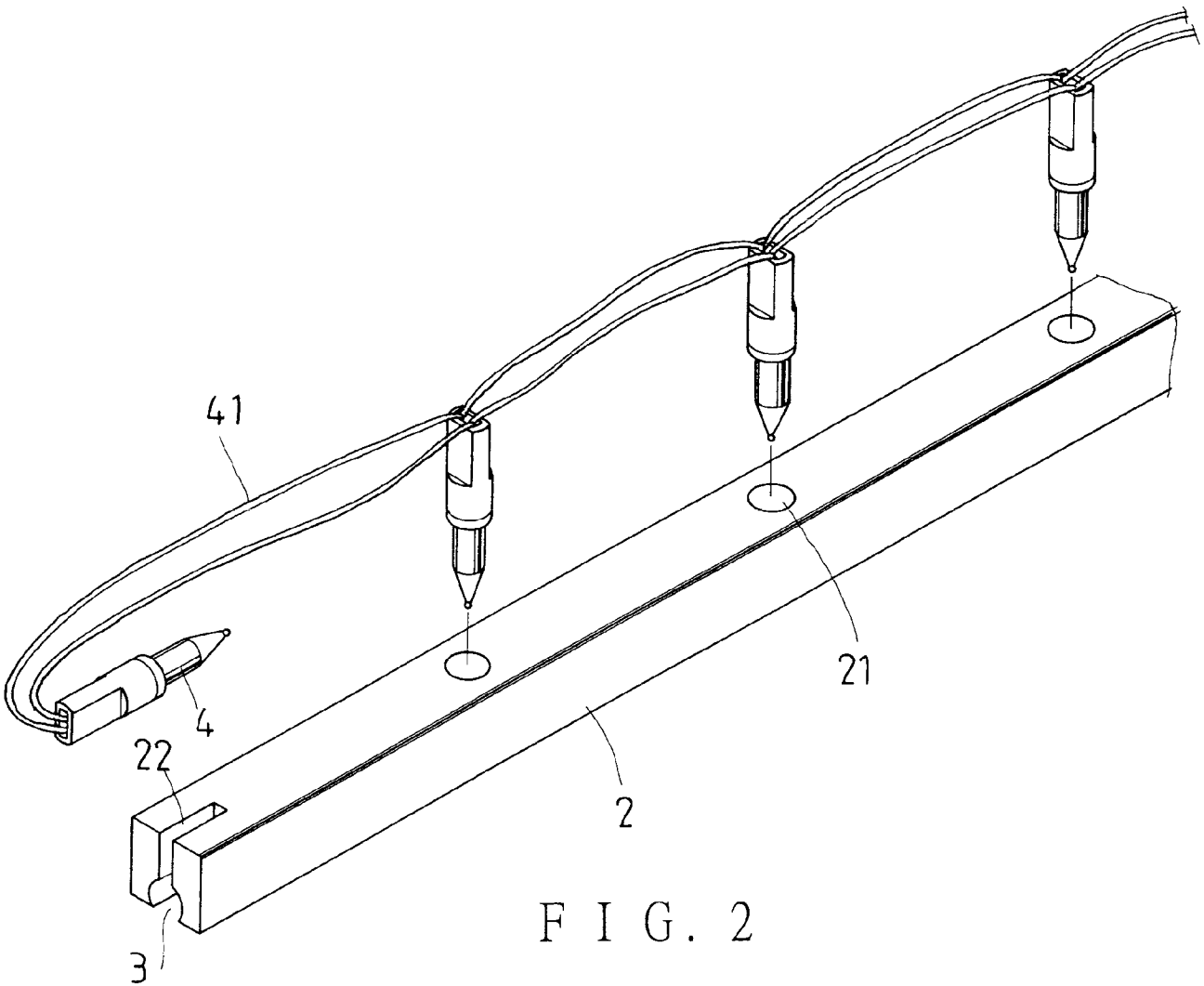
FIG. 2 is a fragmentary exploded perspective view of the beach umbrella of the present invention.

Referring to FIGS. 1 and 2, a beach umbrella of the present invention includes a shank 1, several ribs 2, which are pivoted to the upper end of the shank 1 from the inner ends and radially spread out, and spreaders (not numbered), which are pivoted to the ribs 2 and a movable ring, and lamps 4.

Figure 4:
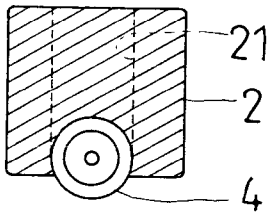
FIG. 4 is a sectional view of the rib according to the first embodiment of the present invention.
Figure 3:
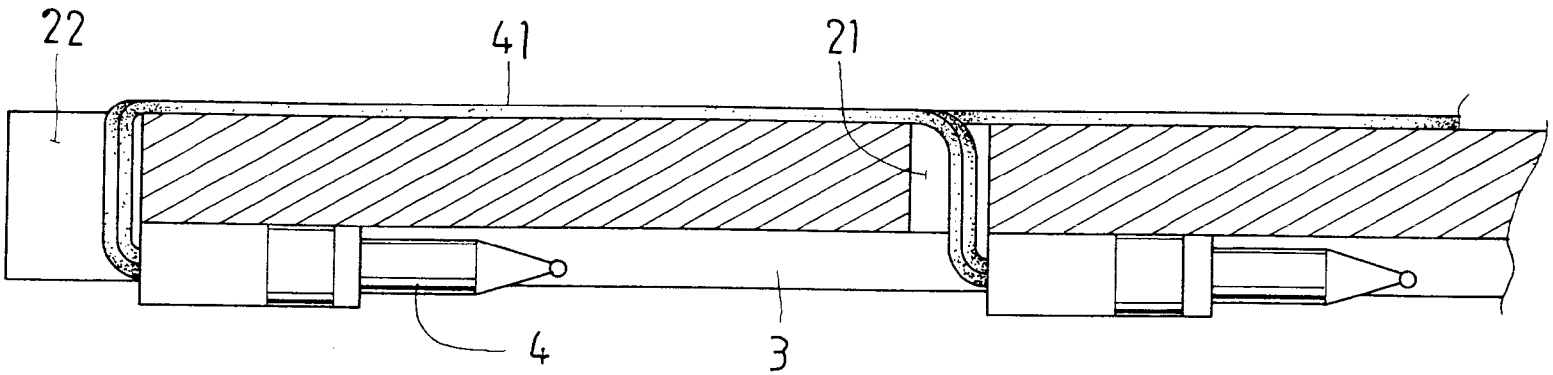
FIG. 3 is a fragmentary section view of the beach umbrella of the present invention.

The ribs 2 each has a receiving trench 3 lengthwise formed on the bottom, several through holes 21 formed on the upper side to communicate with the receiving trench 3, and a gap 22, which is formed at the outer end portion thereof, and communicates with the trench 3. Several of the lamps 4 are connected to a wire 41, and passed through a respective one of the through holes 21 of one of the ribs 2 with the wires 41 being positioned on the rib 2. The lamps 4 are further securely hidden in the receiving trench 3 as shown in FIGS. 3 and 4; the outer end of the wire 41 is passed into the gap 3 with received in the trench 3.

Figure 5:
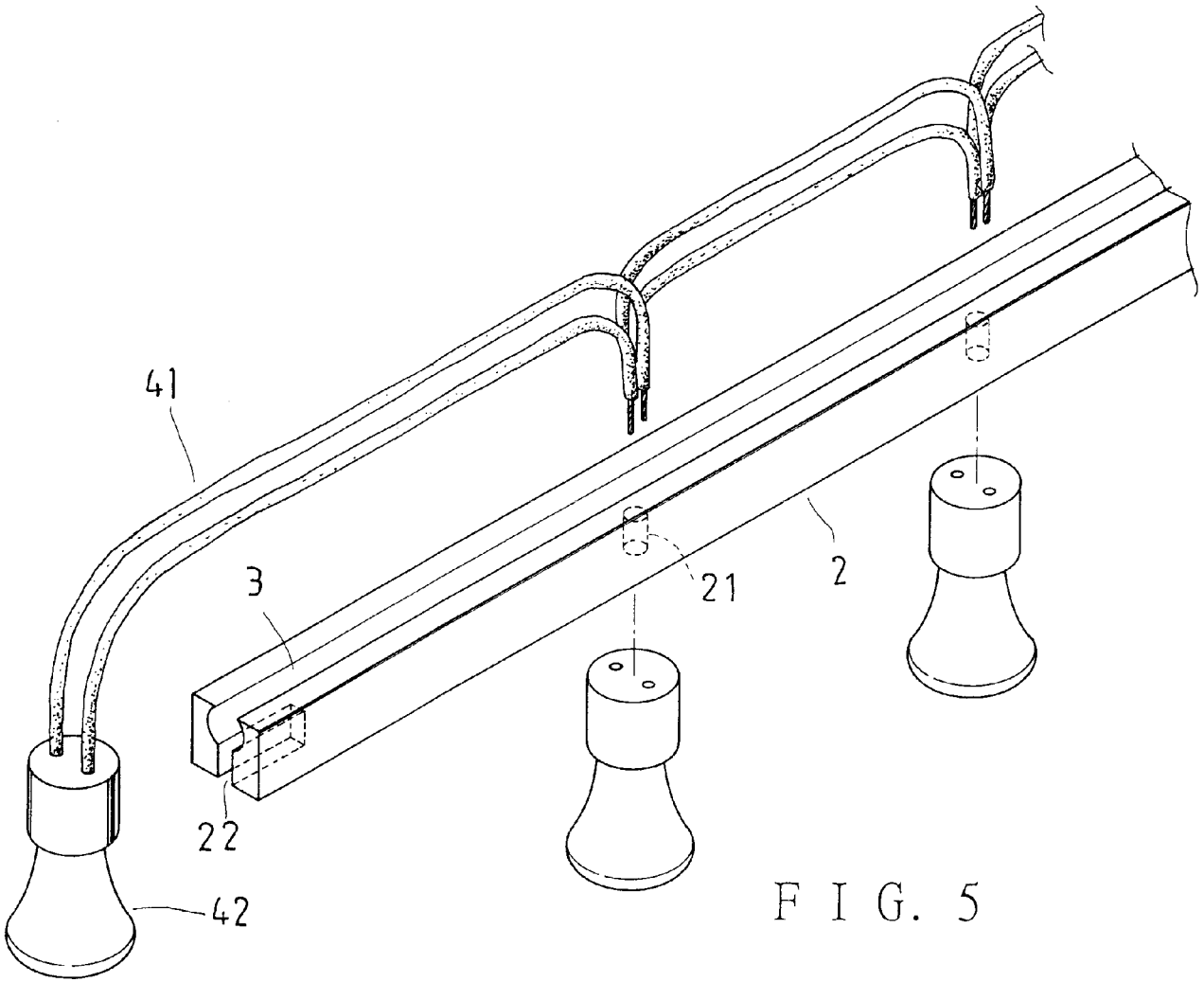
FIG. 5 is a fragmentary exploded perspective view of the beach umbrella of the second embodiment.
Figure 6:
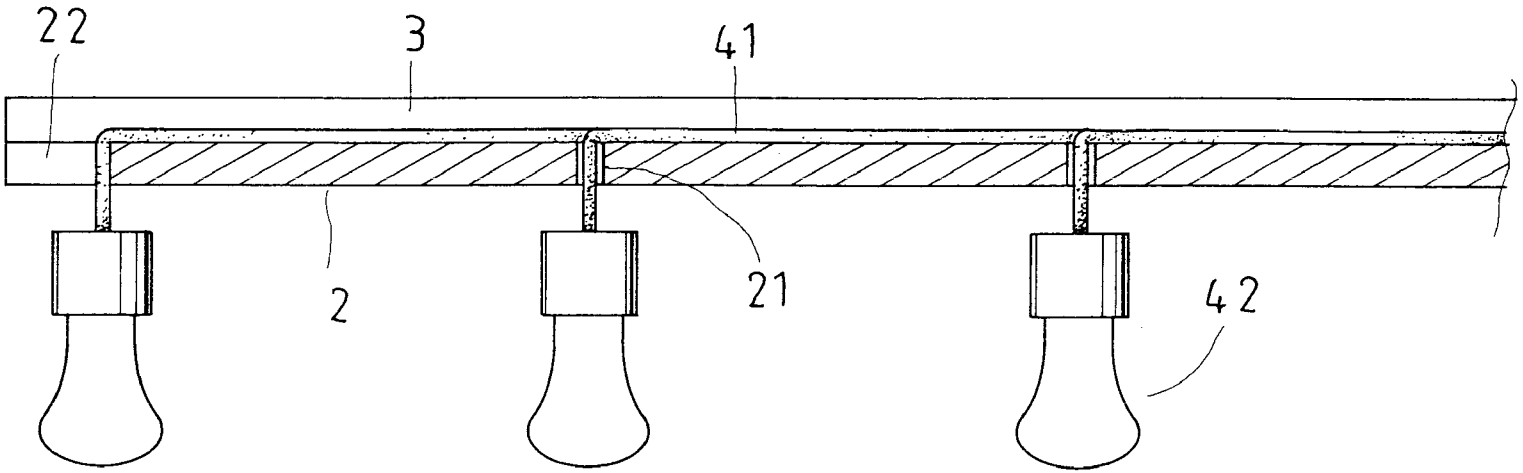
FIG. 6 is a fragmentary section view of the umbrella of the second embodiment.
Figure 7:
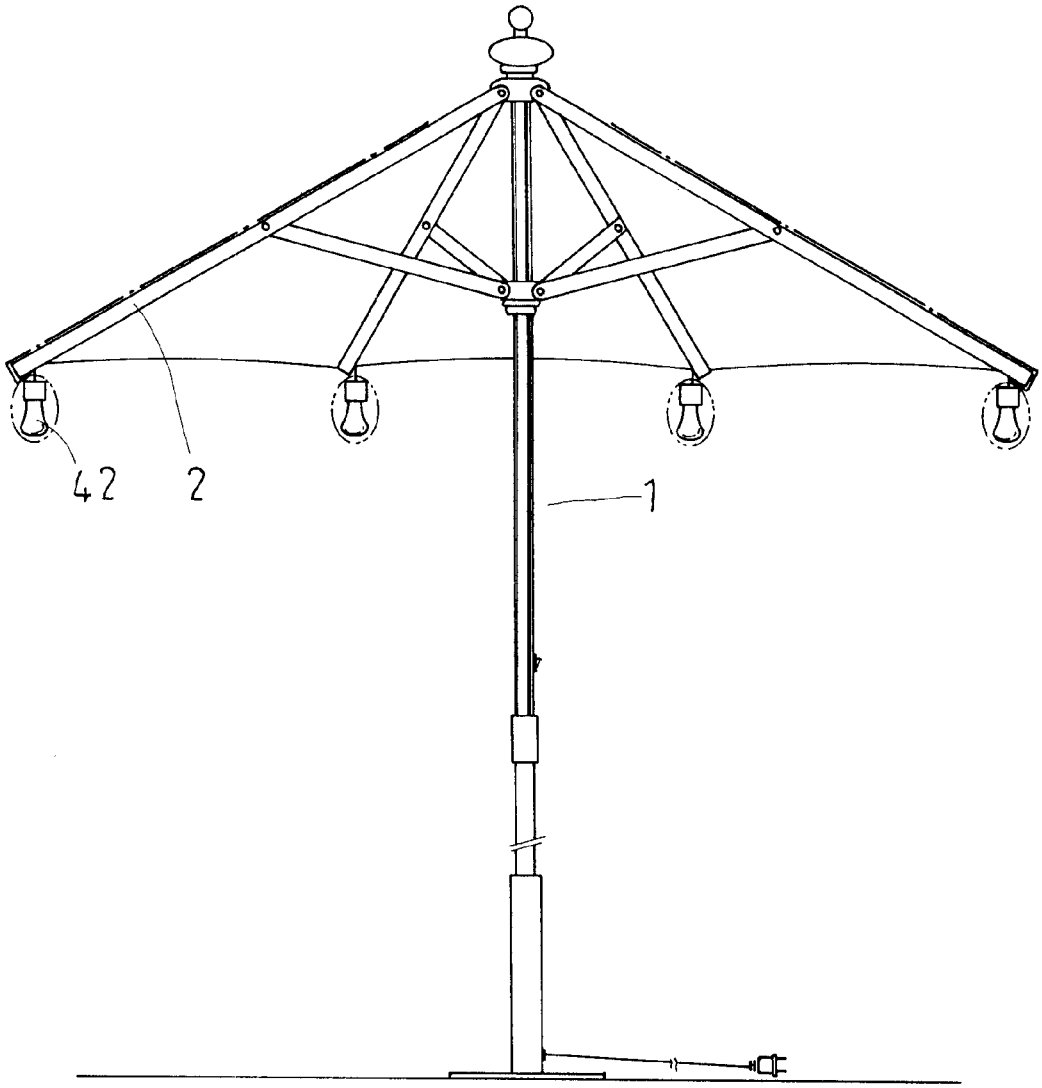
FIG. 7 is a plan view of the umbrella of the second embodiment.
Figure 8:
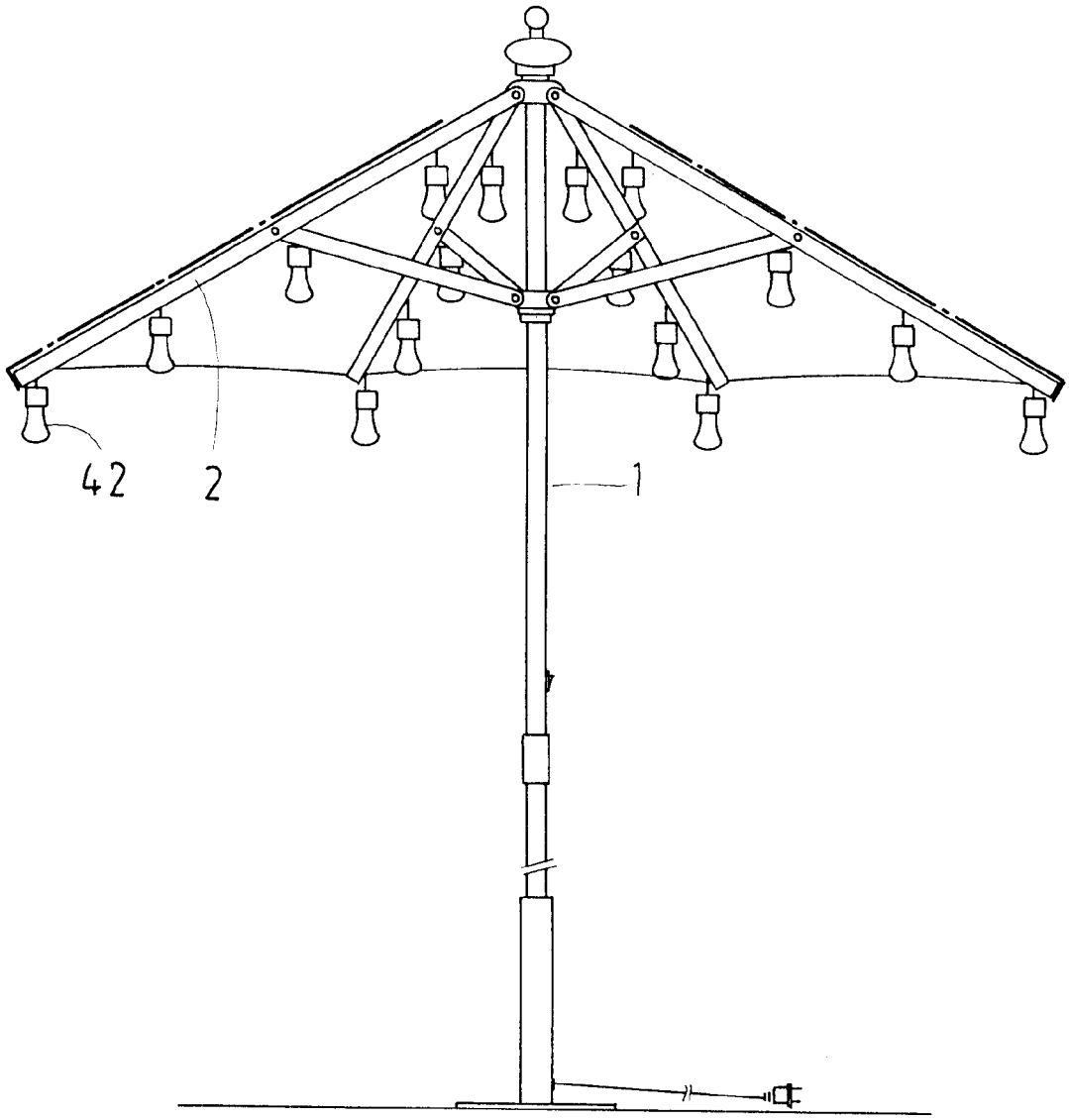
FIG. 8 is another plan view of the umbrella of the second embodiment.
Figure 9:
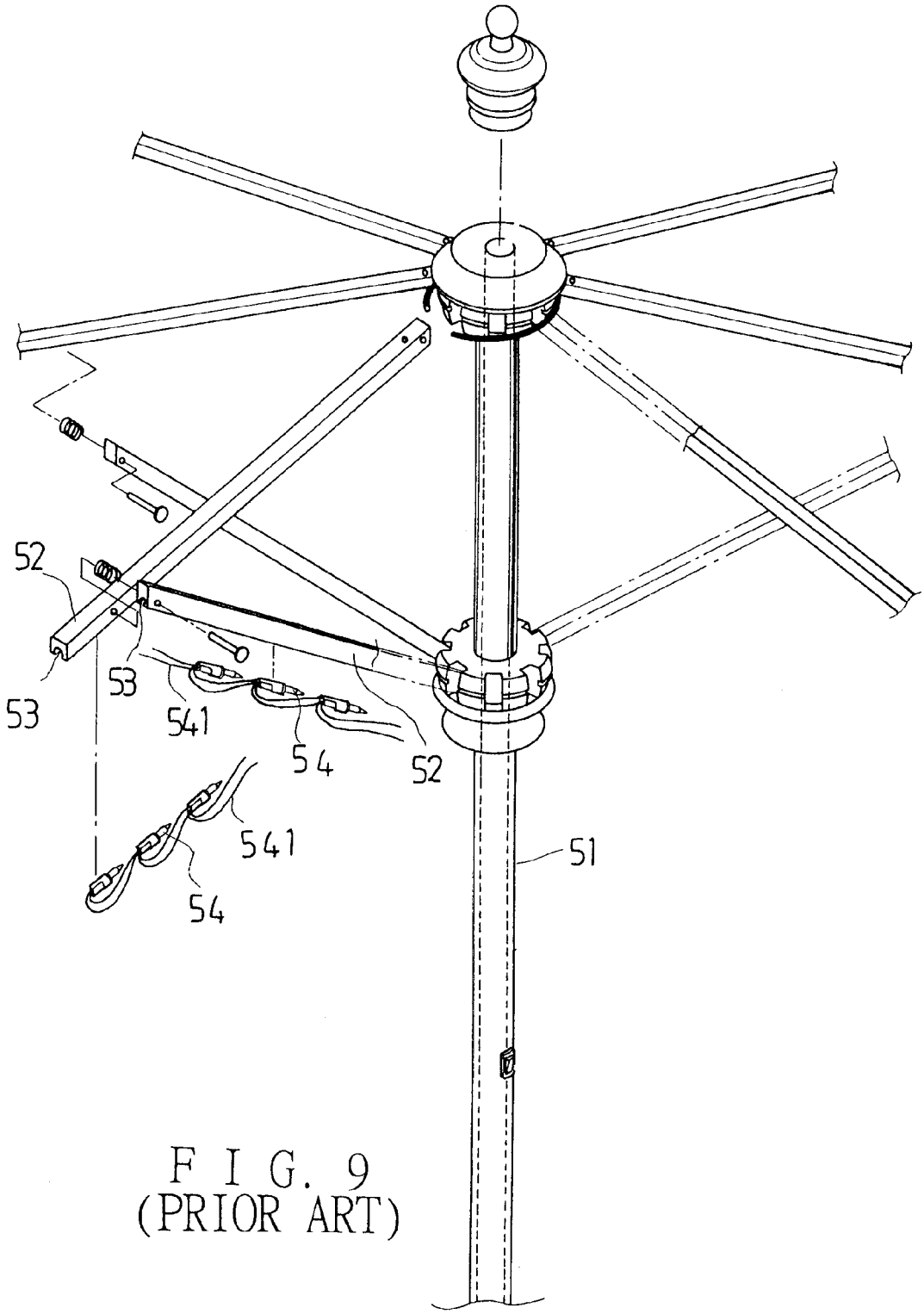
F I G. 9 (PRIOR ART)
FIG. 9 is an exploded perspective view of the conventional beach umbrella.
Figure 11:
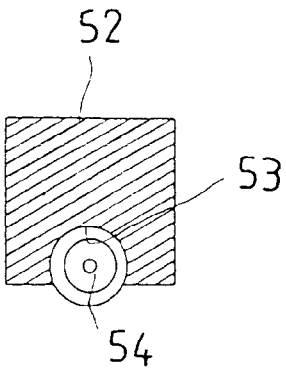
FIG. 11 (PRIOR ART)
FIG. 11 is a sectional view of the rib of the beach umbrella in FIG. 9.
Figure 10:
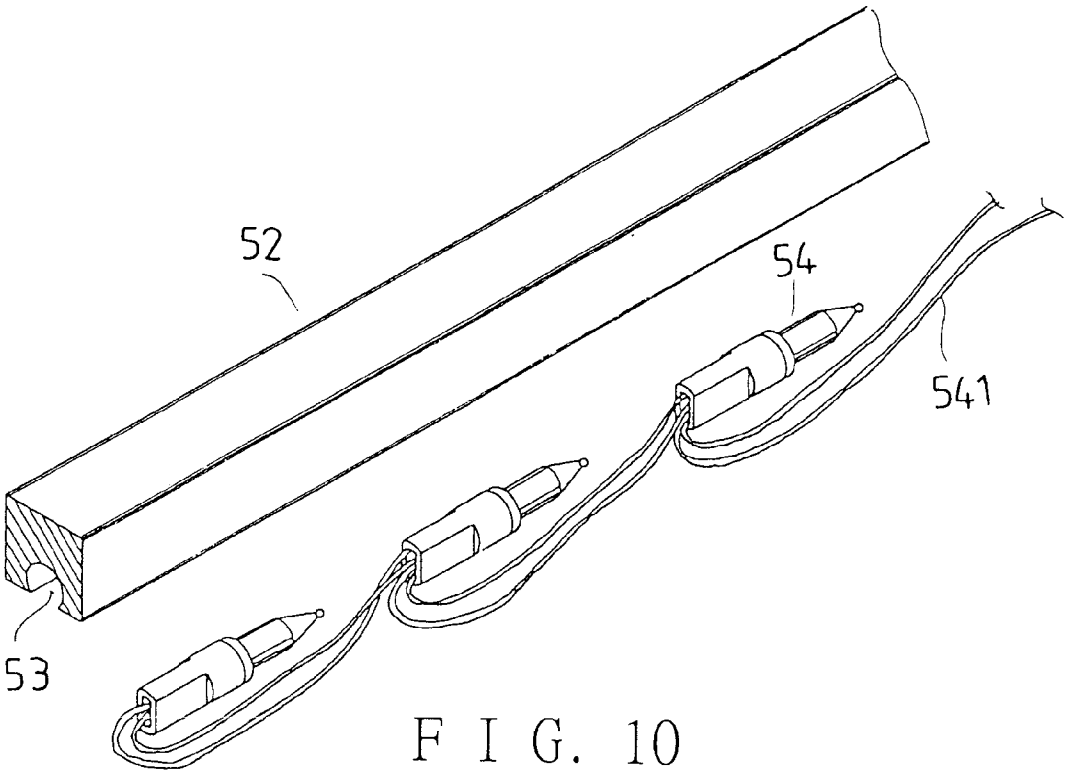
FIG. 10 (PRIOR ART)
FIG. 10 is a fragmentary exploded perspective view of the beach umbrella in FIG. 9.

Referring to FIGS. 5 and 6, a rib 2 of an umbrella according to a second embodiment of the present invention includes a receiving trench 3 lengthwise formed on the upper side thereof, several through holes 21 formed on the bottom to communicate with the trench 3 and a gap 22, which is formed at the outer end, and also communicates with the trench 3. A wire 41 having several branches is hidden in the receiving trench 3 with the branches being passed through a respective one of the through holes 21, and with the outer end portion of the wire 41 being secured in the gap 22. The outer ends, and the branches of the wire 41 are further each connected to a lamp 42 placed just below the rib 2, as shown in FIG. 6. Thus, the beach umbrella has the lamps fitted to the ribs thereof. And, the user can decide the number of lamps to be fitted to the ribs according to the needs, as shown in FIGS. 7 and 8.

From the above description, it can be easily understood that the beach umbrella with lamps of the present invention has the following desirable features:

1. Because most part of the weight of the lamps is supported by the wire held on the ribs, and only little part of the weight is held by the receiving trench (the first embodiment), the lamps can't possibly fall down, and are much leas likely to fall off than those of the conventional umbrella when the umbrella is being folded or stretched. And, the lamps are desirably spaced out by the through holes.
2. The umbrella of the second embodiment allows lamps of various shapes and sizes to be securely fitted to, therefore it can be decorated with different lamps to suit various events.

What is claimed is:

1. A beach umbrella with lamps, comprising:

a shank;

a plurality of ribs pivoted to said shank from inner ends thereof;

a plurality of spreaders each pivoted at an outer end thereof to one of said ribs and pivoted at an inner end thereof to a ring mounted on said shank, said ribs each having a receiving trench lengthwise formed thereon; and, a set of lamps, said set of lamps including a plurality of subsets of said lamps where each of said subsets of lamps are connected to one of a plurality of branches of a single wire placed along one of said ribs, a plurality of through holes being formed through each of said ribs and communicating with said trench for permitting said branches of said wires to be passed through with said lamps and said wires being positioned on opposing sides of said ribs, each said lamp being received by a corresponding through hole, said lamps projecting light to a region beneath said ribs.

2. The beach umbrella with lamps as claimed in claim 1, wherein said receiving trenches are formed on bottoms of said ribs, and said lamps are substantially hidden in said receiving trenches with said wires being held on said ribs.

3. The beach umbrella with lamps as claimed in claim 1, wherein said receiving trenches are formed on upper sides of said ribs, and said wires are hidden in said trenches with said lamps being positioned below said ribs.

4. The beach umbrella with lamps as claimed in claim 1, wherein said ribs each further has a gap at an outer end portion, said gap communicating with a corresponding one of said trenches for an outer end portion of a respective one of said wires to be securely fitted thereinto.

* * * * *